US006948483B2

(12) United States Patent
Veinotte

(10) Patent No.: US 6,948,483 B2
(45) Date of Patent: Sep. 27, 2005

(54) EXHAUST GAS RECIRCULATION SYSTEM

(75) Inventor: Andre Veinotte, Dresden (CA)

(73) Assignee: Siemens VDO Automotive Inc., Ontario (CA)

( * ) Notice: Subject to any disclaimer, the term of this patent is extended or adjusted under 35 U.S.C. 154(b) by 167 days.

(21) Appl. No.: 10/164,559

(22) Filed: Jun. 10, 2002

(65) Prior Publication Data

US 2002/0185116 A1 Dec. 12, 2002

Related U.S. Application Data

(60) Provisional application No. 60/297,111, filed on Jun. 8, 2001.

(51) Int. Cl.[7] ..... F02M 25/07

(52) U.S. Cl. ..... 123/568.18; 123/568.24

(58) Field of Search ..... 123/568.18, 568.24, 123/568.23, 568.25, 568.26, 568.27, 568.29, 568.11

(56) References Cited

U.S. PATENT DOCUMENTS

| | | | | |
|---|---|---|---|---|
| 3,741,179 | A | 6/1973 | Vartanian | |
| 4,094,285 | A | 6/1978 | Oyama et al. | |
| 4,171,689 | A | 10/1979 | Eheim | |
| 4,196,708 | A | 4/1980 | May et al. | |
| 4,214,562 | A | 7/1980 | Mowbray | |
| 4,222,356 | A | 9/1980 | Ueda | |
| 4,230,080 | A | 10/1980 | Stumpp et al. | |
| 4,237,837 | A | 12/1980 | Toda et al. | |
| 4,279,473 | A | 7/1981 | Yamana | |
| 4,280,470 | A | 7/1981 | Ueda | |
| 4,286,567 | A | 9/1981 | Ueda | |
| 4,295,456 | A | 10/1981 | Nomura et al. | |
| 4,329,965 | A | 5/1982 | Ueda et al. | |
| 4,364,369 | A | 12/1982 | Nomura et al. | |
| 5,333,456 | A | 8/1994 | Bollinger | 60/605 |
| 5,937,834 | A | 8/1999 | Oto | |
| 6,135,415 | A * | 10/2000 | Kloda et al. | 251/129.11 |

FOREIGN PATENT DOCUMENTS

| | | | |
|---|---|---|---|
| EP | 0 840 000 | 5/1998 | |
| JP | 11 294267 | 10/1999 | |
| JP | 2000 045879 | 2/2000 | |
| WO | WO 2002101223 A1 * | 12/2002 | F02M/25/07 |

OTHER PUBLICATIONS

U.S. Appl. No. 10/290,441, filed Nov. 8, 2002, Veinotte, Modular Exhaust Gas Recirculation Assembly.

U.S. Appl. No. 10/387,416, filed Mar. 14, 2003, Veinotte, Modular Exhaust Gas Recirculation Assembly.

U.S. Appl. No. 10/387,439, filed Mar. 14, 2003, Veinotte, Electric Actuator Assembly and Method for Controlling an Exhaust Gas Recirculation Assembly.

* cited by examiner

*Primary Examiner*—Tony M. Argenbright
*Assistant Examiner*—Hyder Ali

(57) ABSTRACT

An exhaust gas recirculation system including an intake passage, an exhaust passage joining the intake passage at a junction and in fluid communication with the intake passage, and a closing member having a first position and a second position. When in the first position, the closing member blocks fluid communication between the intake passage and the exhaust passage. When in the second position, the closing member permits fluid communication between the intake passage and the exhaust passage and creates a pressure differential across the junction so that the fluid is either drawn or forced into the intake passage.

17 Claims, 4 Drawing Sheets

EXHAUST GAS RECIRCULATION SYSTEM

This application claims priority of copending provisional application(s) No. 60/297,111 filed on Jun. 8, 2001 which is hereby incorporated by reference.

BACKGROUND OF THE INVENTION

One conventional exhaust gas recirculation (EGR) system for compression ignition internal combustion engines uses two actuators. The first actuator creates a pressure differential in the intake passage that draws exhaust gas from the exhaust passage into the intake passage where it mixes with the intake charge. The second actuator regulates the flow rate of exhaust gas in the exhaust passage that is drawn into the intake passage by the first actuator.

Another conventional EGR system employs a single actuator to regulate the flow rate of exhaust gas drawn into the intake passage from the exhaust passage. A stationary throttling device is located in the exhaust passage to promote the flow of exhaust gas into the intake passage. The negative pressure pre-existing in the intake passage created during the intake stroke of the engine provides the pressure differential needed to draw the exhaust gas into the intake passage.

SUMMARY OF THE INVENTION

There is provided an exhaust gas recirculation system including an intake passage, an exhaust passage joining the intake passage at a junction and in fluid communication with the intake passage, and a closing member having a first position and a second position. When in the first position, the closing member blocks fluid communication between the intake passage and the exhaust passage. When in the second position, the closing member permits fluid communication between the intake passage and the exhaust passage and creates a pressure differential across the junction so that the fluid is either drawn or forced into the intake passage.

There is also provided an exhaust gas recirculation system including an intake passage, an exhaust passage in fluid communication with the intake passage, and a closing member movably mounted in the exhaust passage and having a first position and a second position. When in the first position, the closing member blocks fluid communication between the intake passage and the exhaust passage and is outside of a fluid stream of the exhaust passage when fluid is flowing through the exhaust passage. When in the second position, the closing member opens fluid communication between the intake passage and the exhaust passage and extends into the fluid stream of the exhaust passage when fluid is flowing through the exhaust passage.

There is yet also provided an exhaust gas recirculation system including an intake passage, an exhaust passage in fluid communication with the intake passage, a closing member having a first position and a second position, and a recess receiving the closing member when the closing member is in the first position. When in the first position, the closing member blocks fluid communication between the intake passage and the exhaust passage and is outside of a fluid stream of one of the intake passage and the exhaust passage when fluid is flowing through the one of the intake passage and the exhaust passage. When in the second position, the closing member opens fluid communication between the intake passage and the exhaust passage and extends into the fluid stream of the one of the intake passage and the exhaust passage when fluid is flowing through the one of the intake passage and the exhaust passage. The recess is in an inner wall of the one of the intake passage and the exhaust passage.

There is further provided a method for controlling exhaust gas recirculation for an internal combustion engine. The engine includes an exhaust passage in fluid communication with an intake passage and a port fluidly joining the intake passage and the exhaust passage. The method includes simultaneously positioning a closing member to open fluid communication between the intake passage to the exhaust passage and creating, with the closing member, a pressure differential across the port so that the fluid is either drawn or forced into the intake passage.

There is yet further provided a method for controlling exhaust gas recirculation for an internal combustion engine. The engine includes an exhaust passage selectively fluidly connected to an intake passage. The method includes forcing exhaust gas from the exhaust passage into the intake passage.

BRIEF DESCRIPTION OF THE DRAWINGS

The accompanying drawings, which are incorporated herein and constitute part of this specification, illustrate an embodiment of the invention, and, together with the general description given above and the detailed description given below, serve to explain the features of the invention.

DETAILED DESCRIPTION OF THE PREFERRED EMBODIMENTS

Figure 1:
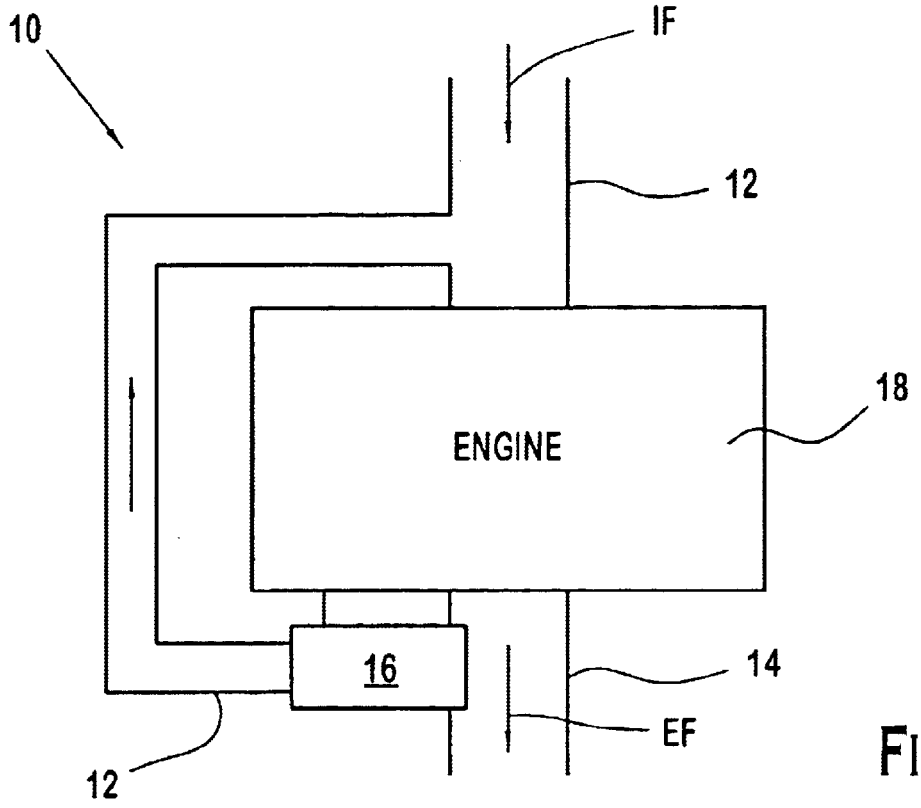
FIG. 1 is a schematic in accordance with a first embodiment of an exhaust gas recirculation system of an internal combustion engine according to the present invention.
Figure 2:
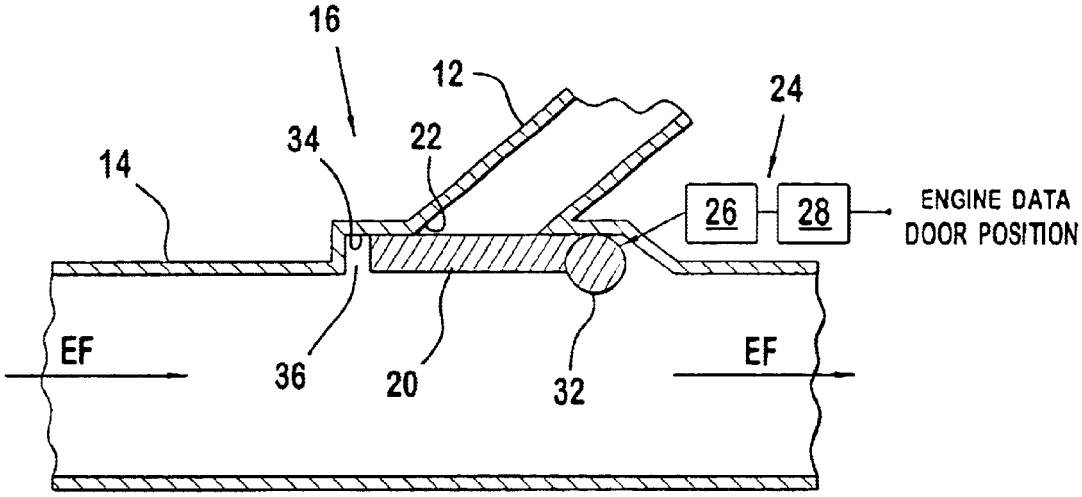
FIG. 2 is a schematic of a valve assembly of the exhaust gas recirculation system of FIG. 1, where the valve assembly is in a first operating condition.
Figure 3:
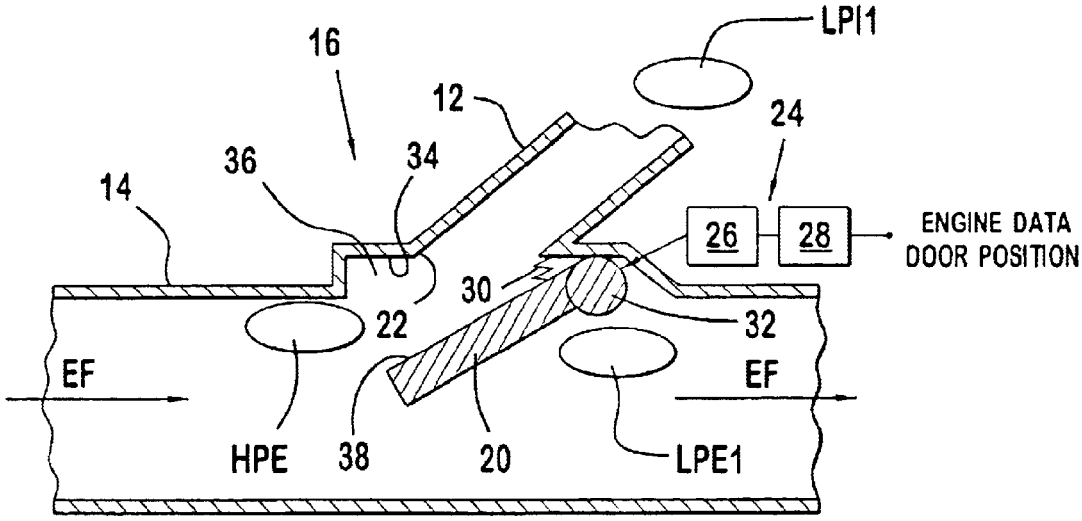
FIG. 3 is a schematic of the valve assembly of FIG. 2 in a second operating condition.

Referring to FIGS. 1–3, a first configuration of an exhaust gas recirculation system (EGR) 10 includes an intake passage 12, an exhaust passage 14 in fluid communication with the intake passage 12 and a valve assembly 16 between the intake passage 12 and the exhaust passage 14 to selectively open and close the fluid communication between the intake passage 12 and the exhaust passage 14. The EGR 10 can be used with an internal combustion engine 18 to control when and the amount of exhaust gas flowing in the exhaust passage 14 enters the intake passage 12 to mix with an intake charge flowing in the intake passage 12 on route to a combustion chamber (not shown) of the engine 18. The EGR 10 can be used with a compression-ignition engine or a spark-ignition engine. Preferably, the EGR 10 is used in a compression-ignition engine.

Referring to FIGS. 2 and 3, the valve assembly 16 includes a closing member 20, a port 22 fluidly connecting the exhaust passage to the intake passage 12, and a drive assembly 24 for moving the closing member 20. The closing member 20 performs two functions. First, it opens and closes the port 22 to selectively open and close the fluid communication between the intake passage 12 and the exhaust passage 14. Second, after the closing member 20 opens the fluid communication between the intake passage 12 and the exhaust passage 14, the closing member 20 meters the flow rate of exhaust gas that passes from the exhaust passage 14 to the intake passage 12.

The drive assembly 24 includes a servo assembly 26 drivingly coupled to the closing member 20 and a servo controller 28 electrically connected to the servo assembly 26, and a return spring 30 (FIG. 3). The return spring 30 biases the closing member 20 toward the port 22. Preferably, the servo assembly 26 includes an electric motor drivingly coupled to a gear train. The servo controller 28 generates a drive signal and sends it to the servo actuator to move the closing member 20 from the first position to the second position. Preferably, the servo controller 28 follows a closed-loop algorithm using an engine performance data input and a door position input. Alternatively, the servo controller 28 can follow an open-loop algorithm and additional inputs can be provided to the servo controller 28, such as transmission gear selection and vehicle inclination.

Comparing FIGS. 2 and 3, the closing member 20 is movable between a first position (FIG. 2) where the closing member 20 blocks fluid communication between the intake passage 12 and the exhaust passage 14 and a second position (FIG. 3) where the closing member 20 opens fluid communication between the intake passage 12 and the exhaust passage 14 and selectively meters the flow rate of exhaust gas passing into the intake passage 12. The exhaust gas flows through the exhaust passage in the direction indicated by arrow EF.

FIGS. 2 and 3 schematically represent the closing member 20 as a door pivoting at one end about a rotary shaft 32. Alternatively, the closing member 20 can be displaced in a different manner between the first position and the second position, such as sliding along a linear path. The servo assembly 26 can include any suitable driving mechanism that imparts the chosen pivoting motion, linear motion or other motion on the closing member, such as, an electric or pneumatic motor with or without and gear train, or a solenoid with or without a linkage.

When in the first position, as shown in FIG. 2, the closing member 20 sealingly engages a valve seat of the port 22 to seal the port 22 and block the flow of exhaust gas from the exhaust passage 14 into the intake passage 12. A recess 36 receives the closing member 20 when the closing member 20 is in the first position. When the closing member 20 is in the recess 36, the closing member 20 is outside of the fluid stream of exhaust gas flowing in the exhaust passage 14 and has a minimum influence on the exhaust gas stream.

When in the second position, as shown in FIG. 3, the closing member 20 is disengaged from the valve seat 34 to open the port 22 and permit fluid communication between the exhaust passage 14 and the intake passage 12. In the second position, the closing member 20 extends away from intake passage 12 and extends into the exhaust gas stream flowing in the exhaust passage 14. By extending into the exhaust gas stream, the closing member 20 creates a high pressure region HPE in the exhaust passage 14 that is upstream of and adjacent to the port 22 and an exhaust low pressure region LPE1 in the exhaust passage 14 that is positioned downstream of the port 22. The closing member 20 can vary the pressure value of the high pressure region HPE by the amount to which it extends into the exhaust gas stream. As will be explained below, by varying the pressure value of the high pressure region HPE, the closing member 20 can meter the volume of exhaust gas entering the intake passage 12.

During the intake cycle of the engine, an intake low pressure region LPI1 exists in the intake passage 12 that is less than the high pressure region HPE. The pressure differential between the high pressure region HPE in the exhaust passage 14 and the intake low pressure region LPI1 in the intake passage 12 forces exhaust gas into the intake passage by pushing the exhaust gas from the exhaust passage 14 through the open port 22 and into the intake passage 12.

The closing member 20 further includes an operative surface 38 that creates the high pressure region HPE. The extent to which of the operative surface 38 reaches into the exhaust gas stream controls the value of the high pressure region HPE and, thus, the pressure differential between the high pressure region HPE and the intake low pressure region LPI1 during the intake cycle of the engine. The geometry of the operative surface 38 is, preferably, chosen to provide an optimum value for the high pressure region HPE. The selected geometry must balance with the capacity of the drive assembly 24 and the effect the operative surface has on flow restriction in the exhaust passage 14. The drive assembly 24 should be of a configuration capable of generating sufficient force to move the closing member 20 between the first position and second position against the resistance created by the exhaust gas stream against the closing member 20 while simultaneously requiring a minimum packaging volume. The flow restriction should minimally affect back pressure exerted on the combustion chamber during the exhaust cycle and, thus, the power production of the engine 18.

The amount of exhaust gas that enters the intake passage 12 is proportional to the pressure differential between the high pressure region HPE and the intake low pressure region LPI1. The pressure value of the intake low pressure region LPI1 remains relatively steady over time. Thus, a change in the flow rate of exhaust gas in the intake passage 12 can be varied by varying the pressure value of the high pressure region HPE.

When the closing member 20 first opens, the closing member 20 reaches into a small amount of the exhaust gas stream and the high pressure region HPE has a value only slightly greater than that of the intake low pressure region LPI1. Accordingly, the pressure differential is small and the flow rate of exhaust gas through the port 20 and into the intake passage is correspondingly small. The pressure value of the high pressure region HPE, and thus the pressure difference and flow rate of exhaust gas passing through the port 22, increases as the closing member 20 reaches farther into the exhaust gas stream flowing in the exhaust passage 14. Therefore, closing member 20 opens fluid communication between the intake passage 12 and the exhaust passage 14 and the closing member 20 also meters the amount of exhaust gas passing into the intake passage 12.

Figure 4:
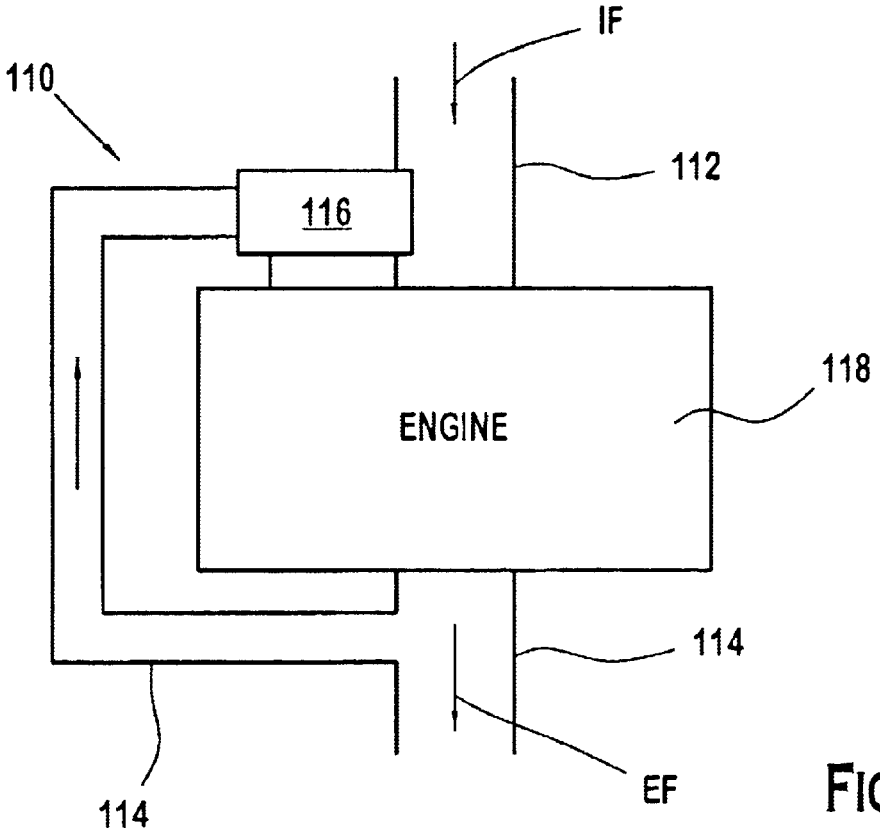
FIG. 4 is a schematic in accordance with a second embodiment of an exhaust gas recirculation system of according to the invention.
Figure 5:
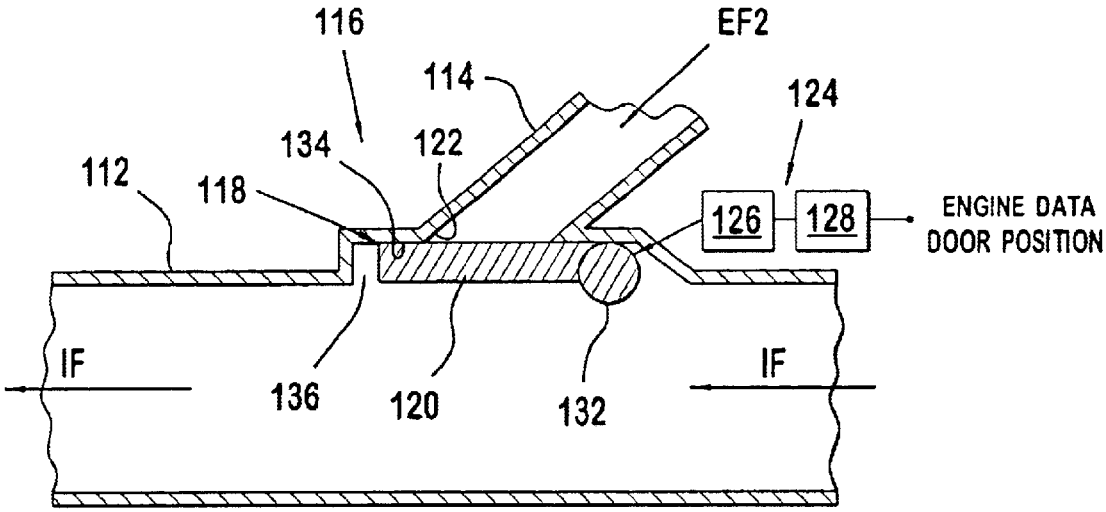
FIG. 5 is a schematic of a valve assembly of the exhaust gas recirculation system of FIG. 4, where the valve assembly is in a first operating condition.
Figure 6:
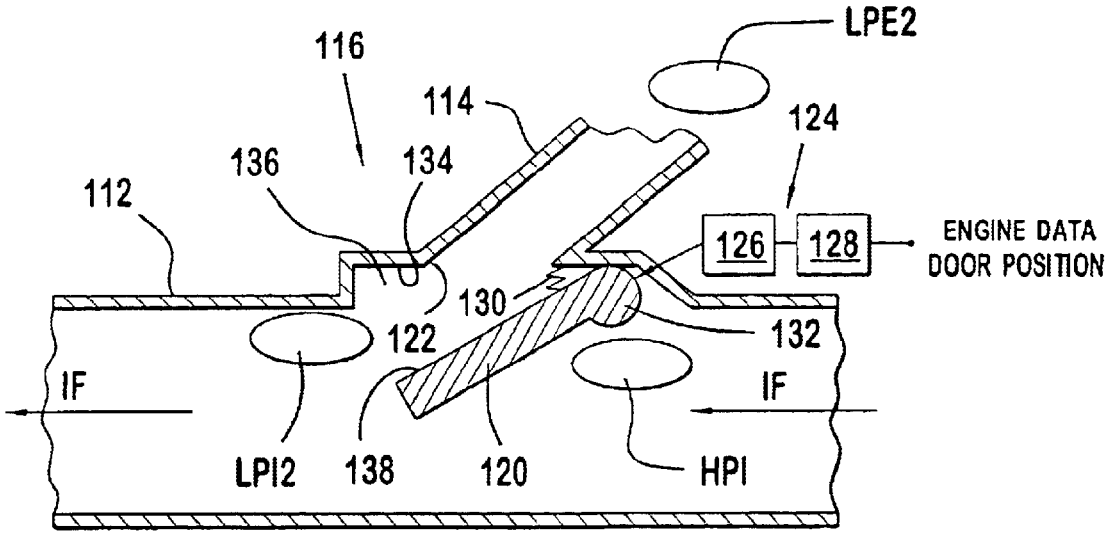
FIG. 6 is a schematic of the valve assembly of FIG. 5 in a second operating condition.

Referring to FIGS. 4–6, and similar to the first configuration the EGR 10 of FIGS. 1–3, a second configuration of an exhaust gas recirculation system (EGR) 110 includes an intake passage 112, an exhaust passage 114 in fluid communication with the intake passage 112 and a valve assembly 116 between the intake passage 112 and the exhaust passage 114 to selectively open and close the fluid communication between the intake passage 112 and the exhaust passage 114. The EGR 110 can be used with an internal combustion engine 118 to control when and the amount of exhaust gas flowing in the exhaust passage 114 enters the intake passage 112 to mix with an intake charge flowing in the intake passage 112 on route to a combustion chamber (not shown) of the engine 118. The EGR 110 can be used with a compression-ignition engine or a spark-ignition engine. Preferably, the EGR 110 is used in a compression-ignition engine.

Referring to FIGS. 5 and 6, the valve assembly 116 includes a closing member 120, a port 122 fluidly connecting the exhaust passage to the intake passage 112, and a drive assembly 124 for moving the closing member 120. The closing member 120 performs two functions. First, it opens and closes the port 122 to selectively open and close the fluid communication between the intake passage 112 and the exhaust passage 114. Second, after the closing member 120 opens the fluid communication between the intake passage 112 and the exhaust passage 114, the closing member 120 meters the flow rate of exhaust gas that passes from the exhaust passage 114 to the intake passage 112.

The drive assembly 124 includes a servo assembly 126 drivingly coupled to the closing member 120 and a servo controller 128 electrically connected to the servo assembly 126, and a return spring 130 (FIG. 6). The return spring 130 biases the closing member 120 toward the port 122. Preferably, the servo assembly 126 includes an electric motor drivingly coupled to a gear train. The servo controller 128 generates a drive signal and sends it to the servo actuator 126 to move the closing member 120 from the first position to the second position. Preferably, the servo controller 28 follows a closed-loop algorithm using an engine performance data input and a door position input. Alternatively, the servo controller 128 can follow an open-loop algorithm and additional inputs can be provided to the servo controller 128, such as transmission gear selection and vehicle inclination.

Comparing FIGS. 5 and 6, the closing member 120 is movable between a first position (FIG. 5) where the closing member 120 blocks fluid communication between the intake passage 112 and the exhaust passage 114 and a second position (FIG. 6) where the closing member 120 opens fluid communication between the intake passage 112 and the exhaust passage 114 and selectively meters the flow rate of exhaust gas passing into the intake passage 112. The exhaust gas flows through the exhaust passage 114 in the direction indicated by arrow EF2 and intake charge gas flows through the intake passage 112 in the direction of arrow IF.

FIGS. 5 and 6 schematically represent the closing member 120 as a door pivoting at one end about a rotary shaft 132. Alternatively, the closing member 120 can be displaced in a different manner between the first position and the second position, such, as sliding along a linear path. The servo assembly 26 can include any suitable driving mechanism that imparts the chosen pivoting motion, linear motion or other motion on the closing member, such as, an electric or pneumatic motor with or without and gear train, or a solenoid with or without a linkage.

When in the first position, as shown in FIG. 5, the closing member 120 sealingly engages a valve seat 134 of the port 122 to seal the port 122 and block the flow of exhaust gas from the exhaust passage 114 into the intake passage 112. A recess 136 receives the closing member 120 when the closing member 120 is in the first position. When the closing member 120 is in the recess 136, the closing member 120 is outside of the fluid stream of intake charge gas flowing in the intake passage 112 and has a minimum influence on the intake charge gas stream.

When in the second position, as shown in FIG. 6, the closing member 120 is disengaged from the valve seat 134 to open the port 122 and permit fluid communication between the exhaust passage 114 and the intake passage 112. In the second position, the closing member 120 extends away from the exhaust passage 114 extends into the intake charge gas stream flowing in the exhaust passage 114. By extending into the intake charge gas stream, the closing member 120 creates a high pressure region HPI in the intake passage 112 that is upstream of the port 122 and intake low pressure region LPI2 in the intake passage 112 that is positioned downstream of and adjacent to the port 122. The closing member 120 can vary the pressure value of the intake low pressure region LPI2 by the amount to which it extends into the intake charge gas stream. As will be explained below, by varying the pressure value of the intake low pressure region LPI2, the closing member 120 can meter the volume of exhaust gas entering the intake passage 112.

During the intake cycle of the engine, the exhaust passage 114 has a low pressure region LPE2 that is approximately equal to ambient atmospheric pressure and a vacuum pressure that is much less than of the ambient atmospheric pressure generated at the junction of the intake passage 112 and the combustion chamber (not shown) of the engine 118. The closing member 120 further includes an operative surface 138 that creates the intake low pressure region LPI2. The extent to which of the operative surface 138 reaches into the exhaust gas stream controls the value of the intake low pressure region LPI2 and, thus, the pressure differential between the exhaust low pressure region LPE2 and the intake low pressure region LPI1 during the intake cycle of the engine. The geometry of the operative surface 138 is, preferably, chosen to provide an optimum value for the intake low pressure region LPI2. The selected geometry must balance with the capacity of the drive assembly 124 and the effect the operative surface has on flow restriction in the intake passage 112. The drive assembly 124 should be of a configuration capable of generating sufficient force to move the closing member 120 between the first position and second position against the resistance created by the intake charge gas stream against the closing member 120 while simultaneously requiring a minimum packaging volume. The flow restriction should minimally affect the flow of intake charge gas to the combustion chamber during the intake cycle and, thus, the power production of the engine 118.

The pressure of the intake charge gas in the intake passage 112 is approximately equal to ambient atmospheric pressure when the closing member 120 is in the first position (FIG. 5). As the closing member 120 moves away from the port 122 and toward the second position (FIG. 6), the intake low pressure region LPI2 is created adjacent the port 122 and has a value slightly less than that of the ambient atmospheric pressure. As the closing member 120 moves farther into the intake charge stream toward the second position, the value of the intake low pressure region LPI2 approaches that of the vacuum pressure. The pressure differential between the intake low pressure region LPI2 in the intake passage 112 and the exhaust low pressure region LPE2 in the exhaust passage 114 forces exhaust gas into the intake passage 112 by drawing the exhaust gas from the exhaust passage 114 through the open port 122 and into the intake passage 112. The amount of exhaust gas that enters the intake passage 112 is proportional to the pressure differential between the intake low pressure region LPI2 and the exhaust low pressure region LPE2. The pressure value of the exhaust low pressure region LPE2 remains relatively steady over time. Thus, a change in the flow rate of exhaust gas in the intake passage 112 can be varied by varying the pressure value of the intake low pressure region LPI2.

The extent to which of the closing member 120 reaches into the exhaust gas stream controls the value of the intake low pressure region LPI2 and, thus, the pressure differential between the intake low pressure region LPI2 and the exhaust low pressure region LPE2 during the intake cycle of the engine. When the closing member 120 first opens, the closing member 120 reaches into a small amount of the intake charge gas stream and the intake low pressure region LPI2 has a value only slightly less than that of the exhaust low pressure region LPE2. Accordingly, the pressure differential is small and the flow rate of exhaust gas through the port 122 and into the intake passage 112 is correspondingly small. The pressure value of the intake low pressure region LPI2, and thus the pressure difference and flow rate of exhaust gas passing through the port 122, increases as the closing member 118 reaches farther into the intake charge gas stream flowing in the intake passage 112. Therefore, closing member 120 opens fluid communication between the intake passage 112 and the exhaust passage 114 and the closing member 120 also meters the amount of exhaust gas passing into the intake passage 112.

Figure 7:
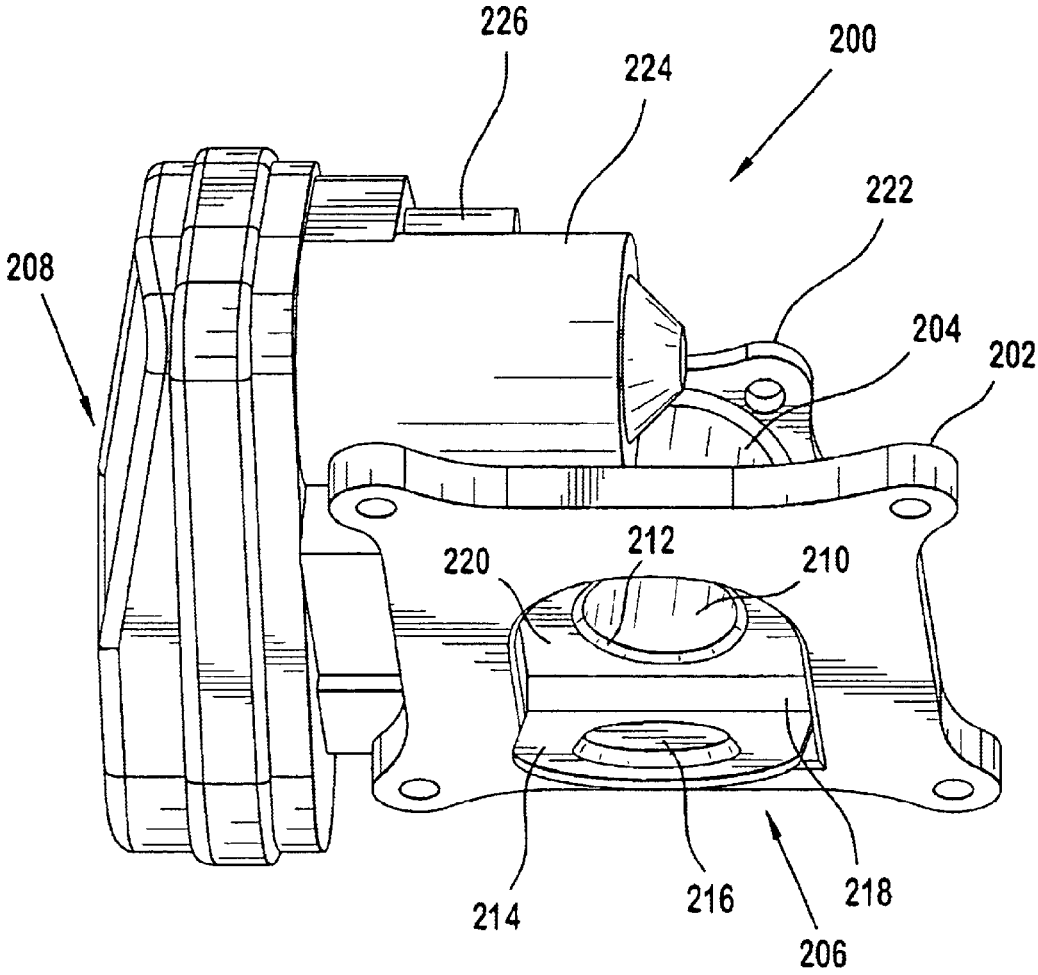
FIG. 7 is a perspective view of an exhaust gas recirculation valve for use in the recirculation systems of FIGS. 1–6.

FIG. 7 illustrates an embodiment of the valve assembly 200 schematically represented in FIGS. 1–6. The valve assembly 200 includes a mounting flange 202 adapted for connection to one of intake passage 12, 112 and the exhaust passage 14, 114, a conduit portion 204 extending from the mounting flange 202, a closing member 206 movably mounted on the mounting flange 202, and a drive assembly 208 supported on the mounting flange 202 and drivingly engaging the closing member 206.

The mounting flange 202 includes a port 210 in fluid communication with the conduit portion 204. The port 210 is in fluid communication with the exhaust passage 14, 114 and the intake passage when the mounting flange 202 is mounted to the other of the intake passage 12, 112 and the exhaust passage 14, 114 as described above with reference to FIGS. 1–6. The port 210 includes a valve seat 214 located at the periphery of the port 210.

The closing member 206 moves between a first position where the closing member 206 blocks fluid communication between the intake passage 12, 112 and the exhaust passage 14, 114 and a second position where the closing member 206 opens fluid communication between the intake passage 12, 112 and the exhaust passage 14, 114 and selectively meters the flow rate exhaust gas passing into the intake passage 12, 112. To better view the details of the valve assembly, FIG. 7 shows the closing member 206 in the second position represented in FIGS. 3 and 6.

The closing member 206 includes a flapper door 214; a seal 216 on the flapper door, and a rotary shaft 218 pivotally coupling the flapper door 214 to the mounting flange 202. The flapper door 214 has a rectangular base 215 and a semicircular end 217. The rectangular base 215 of the flapper door 214 is fixed to the rotary shaft 218. The seal 216 matingly engages the valve seat 212 when the closing member 206 is in the first position to sealingly block the port 210 and close fluid communication between the intake passage 12, 112 and the exhaust passage 14, 114 (see FIGS. 2 and 5).

The mounting flange 202 includes a recess 220 directed toward the fluid stream of one of the intake passage 12, 112 and the exhaust passage 14, 114. The recess 220 is recessed from the inner wall of one of the intake passage 12 and the exhaust passage 14 and the closing member 206 is received in the recess 220 when the closing member 206 is in the first position (see FIGS. 2 and 5).

The conduit portion 204 includes a connecting flange 222 at the end spaced from the mounting flange 202. The connecting flange 222 is connectable to the other of the intake passage 12, 112 and the exhaust passage 14, 114. Preferably, the conduit portion 204 extends from the mounting flange 202 at an oblique angle.

Alternatively, the conduit portion 204 can extend from the mounting flange 202 at any angle or the conduit portion 204 can extend from the mounting flange 202 in a curved manner. It is possible to omit the conduit portion 204 as an integral component of the valve assembly 200 and provide a connecting flange directly on the mounting flange 202 on the side opposite to the face 220. A separate conduit can be secured to this alternate connecting flange. This can provide greater flexibility for packaging and assembling the EGR 10.

A drive housing 224 is attached to the mounting flange 202. The drive housing 224 contains the servo assembly (e.g., 26 of FIG. 2) and a servo controller (e.g., 28 of FIG. 2) electrically connected to the servo assembly. The drive housing 224 includes an electrical connector 226 for attachment to an electrical power supply (not shown) and electrically connected to the servo controller.

As described with reference to FIGS. 2, 3, 5 and 6, above, the servo assembly is drivingly coupled to the rotary shaft 218 and pivots the closing member 206 between the first position and the second position based on a drive signal received from the servo controller, as explained above with reference to FIGS. 1–6.

While the present invention has been disclosed with reference to certain embodiments, numerous modifications, alterations and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What I claim is:

1. An exhaust gas recirculation system comprising:

an intake passage;

an exhaust passage in fluid communication with the intake passage;

a closing member movably mounted in the exhaust passage and having;

a first position where the closing member blocks fluid communication between the intake passage and the exhaust passage and is outside of a fluid stream of the exhaust passage when fluid is flowing through the exhaust passage; and a second position where the closing member opens fluid communication between the intake passage and the exhaust passage and extends into the fluid stream of the exhaust passage when fluid is flowing through the exhaust passage;

a port between and in fluid communication with the intake passage and the exhaust passage;

the closing member closing the port when the closing member is in the first position; and the closing member opening the port when the closing member is in the second position;

wherein the closing member includes a seal engaging the port when the closing member is in the first position.

2. An exhaust gas recirculation system comprising:

an intake passage;

an exhaust passage in fluid communication with the intake passage;

a closing member having:

a first position where the closing member blocks fluid communication between the intake passage and the exhaust passage and is outside of a fluid stream of one of the intake passage and the exhaust passage when fluid is flowing through the one of the intake passage and the exhaust paasage; and a second position where the closing member opens fluid communication between the intake passage and the exhaust passage and extends into the fluid stream of the one of the intake passage and the exhaust passage when fluid is flowing through the one of the intake passage and the exhaust passage;

a recess in an inner wall of the one of the intake passage and the exhaust passage to receive the closing member when the closing member is in the first position; and a valve assembly including:

the closing member;

a mounting flange connected to the one of the intake passage and the exhaust passage and including a port in fluid communication with the intake passage and the exhaust passage;

the closing member connected to the mounting flange, sealing the port when the closing member is in the first position, and opening the port when the closing member is in the second position; and a drive assembly supported on the mounting flange and drivingly engaging the closing member.

3. The exhaust gas recirculation system according to claim 2, wherein the closing member comprises:

a door pivotally coupled to the mounting flange and pivot, into the fluid stream when the closing member moves from the first position to the second position; and a seal mounted on the door;

the port including a valve seat; and the seal engaging the valve seat to seal the port when the movable member is in the first position.

4. The exhaust gas recirculation system according to claim 3, wherein the drive assembly comprises:

a servo assembly drivingly coupled to the door;

a servo controller electrically connected to the servo assembly and actuating the servo assembly to move the door from the first position to the second position; and a spring connected to the door to bias the door toward the first position; and the servo controller actuating the servo assembly to move the door from the first position to the second position against the bias of the spring.

5. The exhaust gas recirculation system according to claim 4, wherein the servo controller comprises a closed-loop controller including:

an engine data input; and a door position input.

6. The exhaust gas recirculation system according to claim 5, wherein the drive assembly further comprises:

a housing supported on the flange and containing the servo assembly and the servo controller; and an electrical connector adapted to connect to an electrical power supply.

7. The exhaust gas recirculation system according to claim 2, wherein the valve assembly further comprises:

a conduit portion connected to and extending from the mounting flange and including a connecting flange spaced from the mounting flange and adapted to be connected to one of the intake passage and the exhaust passage.

8. An exhaust gas recirculation system comprising:

an intake passage;

an exhaust passage joining the intake passage at a junction and in fluid communication with the intake passage; and a closing member pivotally mounted in the exhaust passage and having a first position where the closing member blocks fluid communication between the intake passage and the exhaust passage and a second position where the closing member permits fluid communication between the intake passage and the exhaust passage and creates a pressure differential across the junction so that the fluid is forced into the intake passage.

9. The exhaust gas recirculation system according to claim 8, wherein the pressure differential draws fluid from the exhaust passage into the intake passage.

10. The exhaust gas recirculation system according to claim 9, wherein the exhaust passage has a pressure in a region upstream of the junction;

the closing member creates a pressure in a region of the intake passage downstream of the junction that is lees than the pressure in the exhaust passage region; and the pressure differential is the difference between the pressure in the intake passage region and the pressure in the exhaust passage region.

11. The exhaust gas recirculation system according to claim 8, wherein the pressure differential forces fluid from the exhaust passage into the intake passage.

12. The exhaust gas recirculation system according to claim 11, wherein the intake passage has a pressure in a region downstream of the junction;

wherein the closing member creates a pressure in a region of the exhaust passage upstream of the junction that is greater than a pressure in a region of the intake passage; and the pressure differential is the difference between the pressure in the intake passage region and the pressure in the exhaust passage region.

13. A method for controlling exhaust gas recirculation for an internal combustion engine including an exhaust passage in fluid communication with an intake passage and a port fluidly joining the intake passage and the exhaust passage, the method comprising:

simultaneously pivoting a closing member to open fluid communication between the intake passage to the exhaust passage and creating, with the closing member, a pressure differential across the port so that the fluid is either drawn or forced into the intake passage.

14. The method according to claim 13, further comprising varying the position of closing member to vary the pressure differential while maintaining the open fluid communication between the intake passage and the exhaust passage.

15. The method according to claim 14, wherein creating the pressure differential comprises creating a low pressure region in the intake passage downstream of the port having a pressure that is less than a pressure in a region of the exhaust passage upstream of the port.

16. The method according to claim 14, wherein creating the pressure differential comprises creating a high-pressure region in the exhaust passage upstream of the port that is greater than the pressure in the intake passage.

17. A method for controlling exhaust gas recirculation for an internal combustion engine including an exhaust passage selectively fluidly connected to an intake passage and a closing member pivotally mounted in one of the intake and exhaust passages to selective fluidly connect the exhaust passage to the intake passage, the method comprising:

pivoting the closing member to force exhaust gas from the exhaust passage into the intake passage.

* * * * *